US007604008B2

(12) United States Patent
Gomez

(10) Patent No.: US 7,604,008 B2
(45) Date of Patent: Oct. 20, 2009

(54) SMOKING KIT FOR CUSTOMIZING A TOBACCO PRODUCT

(76) Inventor: Remberto Andres Estrella Gomez, Ave. 27 de Febrero #262, Urb. El Dorado I, Santiago (DO)

( * ) Notice: Subject to any disclaimer, the term of this patent is extended or adjusted under 35 U.S.C. 154(b) by 643 days.

(21) Appl. No.: 10/957,462

(22) Filed: Oct. 1, 2004

(65) Prior Publication Data

US 2005/0072437 A1 Apr. 7, 2005

Related U.S. Application Data

(60) Provisional application No. 60/507,951, filed on Oct. 3, 2003.

(51) Int. Cl.
*A24B 1/04* (2006.01)

(52) U.S. Cl. ..... 131/365

(58) Field of Classification Search ..... 131/360, 131/365, 368

See application file for complete search history.

(56) References Cited

U.S. PATENT DOCUMENTS

| | | | | |
|---|---|---|---|---|
| 191,501 | A | 5/1877 | Willis | |
| 200,889 | A | 3/1878 | Bishop | |
| 236,510 | A * | 1/1881 | Pacholder | 131/364 |
| 304,582 | A | 9/1884 | Thoss | |
| 389,975 | A | 9/1888 | Riedel | |
| 657,403 | A | 9/1900 | Du Brul | |
| 663,073 | A | 12/1900 | Coughtry | |
| 725,671 | A | 4/1903 | Butler | |
| 1,104,779 | A | 7/1914 | Cooley | |
| 1,223,362 | A | 4/1917 | Bock | |
| 3,385,302 | A | 5/1968 | Wattenford | |
| 3,397,700 | A | 8/1968 | Harlow et al. | |
| 4,452,257 | A | 6/1984 | Cartwright et al. | |
| 4,505,282 | A * | 3/1985 | Cogbill et al. | 131/334 |
| 4,687,008 | A * | 8/1987 | Houck et al. | 131/335 |
| 5,147,463 | A | 9/1992 | Eilerman et al. | |
| 5,167,241 | A * | 12/1992 | Ruppert et al. | 131/70 |
| 5,458,107 | A | 10/1995 | Balogh et al. | |
| 5,615,694 | A | 4/1997 | Battard et al. | |
| 5,645,089 | A | 7/1997 | Burger et al. | |
| 5,749,378 | A * | 5/1998 | Ruppert et al. | 131/70 |
| 5,762,074 | A | 6/1998 | Garner | |
| 5,782,246 | A | 7/1998 | Axelrod | |
| 6,053,175 | A | 4/2000 | D'Angelo | |
| 6,164,443 | A | 12/2000 | Mitchell et al. | |

(Continued)

OTHER PUBLICATIONS

*The Case for Blunts, Part II*, 1999 RYO Magazine, A Publication of The Andromedan Design Company, vol. III, No. 3, Aug./Oct. 2002 (www.ryomagazine.com/aug2002/papers.htm).

*Primary Examiner*—Carlos Lopez
(74) *Attorney, Agent, or Firm*—Laurence A. Greenberg; Werner H. Stemer; Ralph E. Locher

(57) ABSTRACT

Smoking kit and techniques for purveying a tobacco product are provided. The kit includes at least one pre-finished tobacco product. The kit further includes at least one wrapping sheet supported by the pre-finished product in a predetermined shape. The wrapping sheet may be configured to exhibit a perceptible olfacto-gustatory characteristic. A consumer can optionally roll the wrapping sheet around the pre-finished product to create a consumer-customized smoking product influenced by the olfacto-gustatory characteristic of the wrapping sheet. Another option may be for the consumer to smoke the pre-finished tobacco product as is.

20 Claims, 2 Drawing Sheets

U.S. PATENT DOCUMENTS

| | | | |
|---|---|---|---|
| 6,321,755 | B1 | 11/2001 | Sinclair, Jr. |
| 6,357,448 | B1 | 3/2002 | Sinclair, Jr. |
| 6,526,986 | B1 | 3/2003 | Sinclair, Jr. |
| D473,339 | S | 4/2003 | Yu |
| 6,742,525 | B2 | 6/2004 | Sinclair, Jr. |
| 2002/0112450 | A1 | 8/2002 | Roscoe |
| 2003/0119644 | A1 | 6/2003 | Draghetti et al. |
| 2003/0217757 | A1 | 11/2003 | Edelmann |
| 2007/0095357 | A1 * | 5/2007 | Besso et al. ..... 131/361 |

* cited by examiner

SMOKING KIT FOR CUSTOMIZING A TOBACCO PRODUCT

This application claims priority to a provisional application titled "Two In One Cigar Wrap", filed on Oct. 3, 2003, having application No. 60/507,951, which is incorporated herein by reference in its entirety.

FIELD OF THE INVENTION

The present invention generally relates to tobacco products for smoking. More specifically, the present invention relates to a smoking kit and techniques that allow including one or more wrapper sheets designed to affect olfacto-gustatory qualities (e.g., flavor, aroma and/or strength of each) of cigars or cigarettes that are included as part of the smoking kit.

BACKGROUND OF THE INVENTION

Throughout the history of mankind, people have enjoyed and continue to enjoy tobacco products. The peoples of the pre-Columbian Americas are believed first to have used tobacco. For example, Native Americans cultivated the tobacco plant and smoked it in pipes purportedly for medicinal and ceremonial purposes.

More recently, a good number of consumers of tobacco products, such as cigar or cigarettes, have a desire or fancy for individually customizing aroma, scent, taste and/or strength of a given product. It is generally known for these consumers to wrap their own tobacco products for smoking. This is generally referred to in the art as "wrap-your-own" product for smoking. However, known techniques for wrapping and/or creating a customized tobacco product have been somewhat burdensome and time consuming for the consumer. For example, in the case of a consumer customizing their own cigarettes, the consumer generally has to make a first purchase for acquiring the cigarette wrappers. A second purchase may then be made of a pre-processed filler tobacco of their choice so that the consumer can finally proceed to roll the cigarette wrapper around the tobacco filler. Thus, the consumer is generally burdened with having to make separate purchasing transactions in order to obtain the components for creating a customized smoking product.

SUMMMARY OF THE INVENTION

Wrapping difficulties can arise because the wrapper may be sold in packages wherein the wrapper is flat, and thus it becomes difficult to roll over the tobacco filler. Moreover, even if the wrapper is pre-rolled in a generally cylindrical shape, it is believed that no prior packaging and/or marketing techniques in the tobacco industry have purveyed such a wrapper component in combination with a pre-finished smoking tobacco product that would optionally allow the consumer to either readily perform a desired customization for the tobacco product, or would allow to enjoy a fine pre-finished product as is.

In view of the foregoing considerations, it is desirable to provide a smoking kit and techniques that would enable a consumer of a smoking tobacco product to readily participate in a final configuration of a cigar or cigarette and, thereby, customize the taste, aroma, flavor, scent and/or strength of the cigar or cigarette to his or her pleasure. This goal should preferably be achieved without having to perform separate purchasing transactions of customizing components or necessitating special instruments and handling of chemical compounds or requiring a superior manual dexterity.

In one aspect the invention provides a smoking kit comprising at least one pre-finished tobacco product and at least one wrapping sheet. The pre-finished tobacco product is smokable as is and the at least one wrapping sheet supported by the pre-finished tobacco product in a predetermined shape. The wrapping sheet can have at least one perceptible olfacto-gustatory characteristic, and can be unwrapped from the pre-finished tobacco product. Also, the at least one wrapping sheet can be rolled by a consumer around the pre-finished tobacco product to create a consumer-customized product influenced by the olfacto-gustatory characteristic of the wrapping sheet.

In another aspect, the invention provides a method for purveying a tobacco smoking product. The method comprises providing a smoking kit including at least one pre-finished tobacco product which is smokable as is. The pre-finished tobacco product can support the at least one wrapping sheet on the pre-finished tobacco product in a predetermined shape. The wrapping sheet can have at least one perceptible olfacto-gustatory characteristic. Also, the wrapping sheet can be unwrapped from the pre-finished tobacco product and can be adhesively affixed by a consumer around the pre-finished tobacco product to create a consumer-customized smoking product having olfacto-gustatory characteristics influenced by the at least one perceptible olfacto-gustatory characteristic of the wrapping sheet.

BRIEF DESCRIPTION OF THE DRAWINGS

Aspects, features and advantages of the present invention will become apparent from the following detailed description of the invention when read with the accompanying drawings in which.

DETAILED DESCRIPTION OF THE INVENTION

Figure 1:
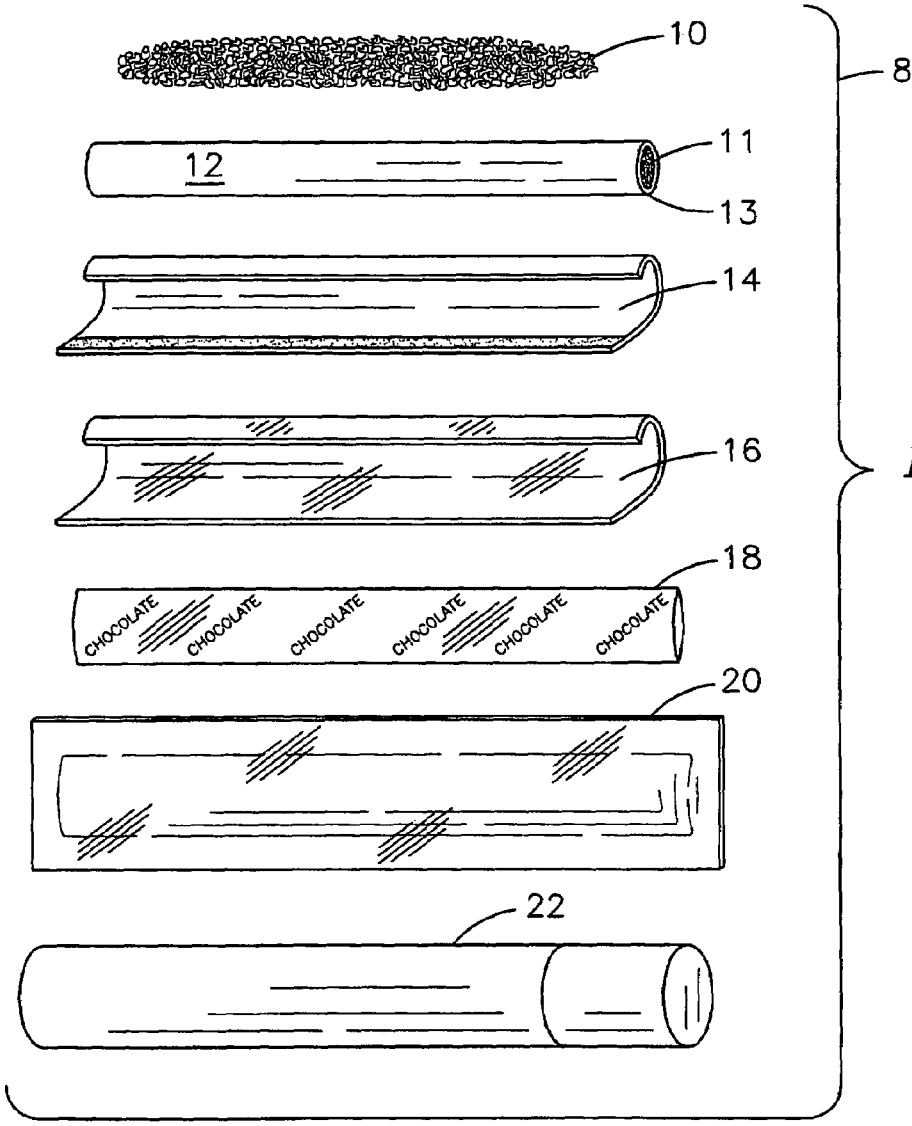
FIG. 1 illustrates in a separated condition exemplary components that in combination make up a tobacco smoking kit embodying aspects of the present invention.

The term "tobacco products" as used herein includes any of various commercially available tobacco products that may be smoked, such as cigarettes and cigars, which generally may (but need not) have a cylindrical-rod shape. For example, a conical shape may be equally feasible for the tobacco product. FIG. 1 illustrates some exemplary constituents that in various forms may comprise a smoking kit 8 embodying aspects of the present invention.

More specifically, FIG. 1 illustrates a bundle of natural tobacco 10 that may have been previously processed as tobacco filler 11 and wrapped in a conventional wrapper 13 to form a pre-finished and fully smokable tobacco product 12. That is, the smoking kit includes one or more pre-finished tobacco products that may be optionally smoked "as is" by the consumer. The kit further includes one or more wrapping sheets 14, each of which may exhibit one or more perceptible olfactory and/or gustatory (referred to herein as olfacto-gustatory) characteristics, such as a respective natural or artificial flavoring and/or scent or may be unscented, as such characteristics may be perceived by the senses of smell and/or taste. That is, at the option of the consumer, one or more wrapping sheets 14 can be rolled onto the pre-finished tobacco product 12 to achieve a desired olfacto-gustatory effect for the customized product. The kit may include an insulator film 16, such as made of polypropylene or any other suitable insulating material, e.g., paper wax.

In one exemplary embodiment, the foregoing constituents of the kit, e.g., one or more pre-finished tobacco products 12, one or more scented or unscented wrapping sheets 14, and one or more insulator films 16, may be pre-packaged in a flexible packaging, such as may comprise a first packaging enclosure 18 that may include a printed indicia of the specific scent of wrapping sheet 14, and a sealed second packaging enclosure 20. By way of example, the packaging enclosures may be made of a suitable flexible polymer, e.g., polypropylene or polyethylene. In another exemplary embodiment, the kit may be packaged in a sealed tubular casing 22 made of a suitable hard plastic or any other suitable relatively lightweight and structurally strong material.

Figure 2:
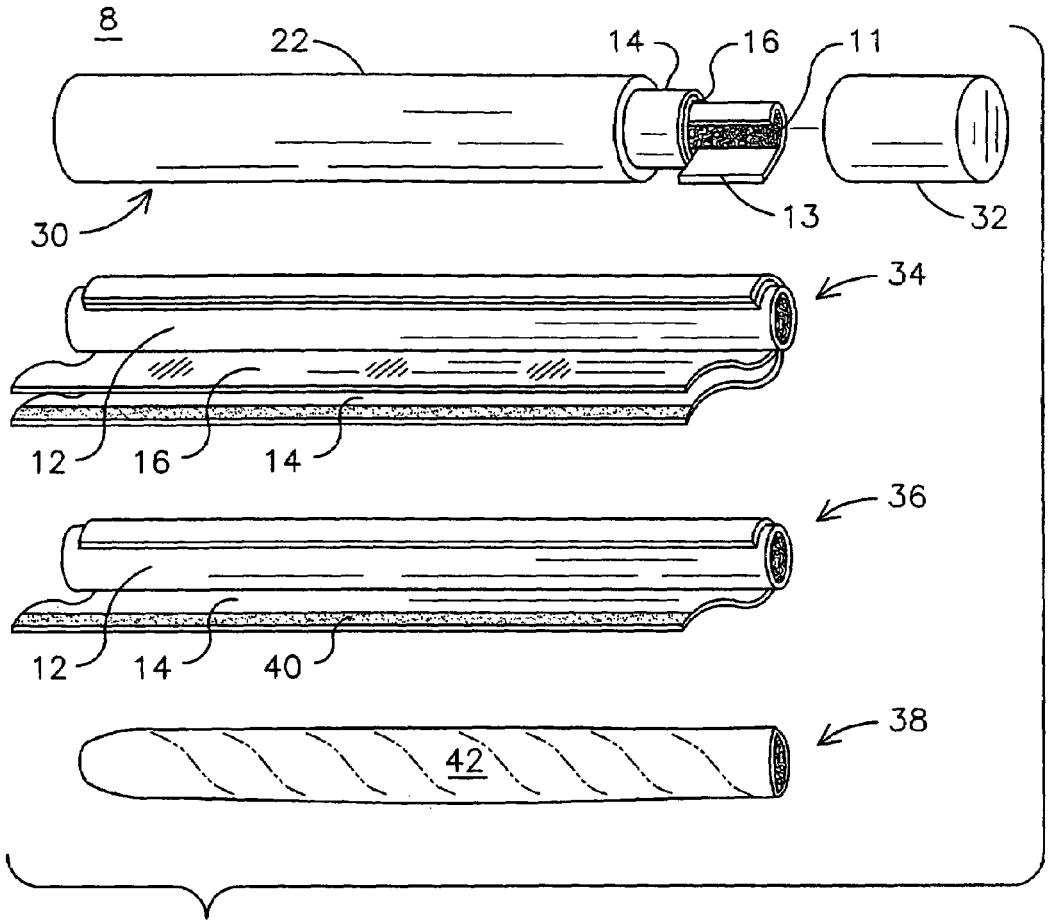
FIG. 2 illustrates a graphical sequence of views for describing exemplary steps in connection with usage of a smoking kit embodying aspects of the present invention.

FIG. 2 illustrates a graphical sequence of views for describing exemplary steps in connection with usage (e.g., assembly) of a smoking kit embodying aspects of the present invention. A first view 30 illustrates a smoking kit 8 as may be exemplarily packaged for delivery to a consumer in hard tubular casing 22.

Upon removal of cap 32 and removal of the contents from tubular casing 22, view 34 illustrates that the pre-finished tobacco product 12 may function as a support structure for maintaining the wrapping sheet 14 in a predetermined shape, such as a generally cylindrical or conical shape. That is, the wrapping sheet 14 may be loosely wrapped (e.g., attached without adhesives) to the pre-finished tobacco product 12. In one exemplary embodiment, insulator film 16 may be sandwiched or interposed between the wrapping sheet 14 (disposed radially outward relative to the insulator film 16), and the pre-finished tobacco product 12 (disposed radially inward relative to the insulator film 16) to, for example, prevent flavorants and/or scents that may be present in the wrapping sheet 14 from leaching out of the wrapping sheet into the adjacent pre-finished smoking product.

At this point, the consumer has the option of unwrapping the insulator film 16 and the scented wrapping sheet 14 from the pre-finished tobacco product 12 and proceeding to directly smoke the pre-finished tobacco product 12, as is. That is, the consumer may choose to smoke without performing any customizing actions. Alternatively, as illustrated in views 36 and 38, the consumer may proceed to remove and discard the insulator 16, and, upon moistening at least one visually or otherwise identifiable (e.g., raised) border 40 of wrapping sheet 14, e.g., pre-treated with a moist-activated adhesive, the consumer may then proceed to roll and adhesively affix the wrapper sheet 14 onto the pre-finished tobacco product 12 to create a consumer-customized tobacco product 42 having a desired olfacto- gustatory effect, at least part of which is contributed by one or more characteristics imparted by the wrapping sheet 14.

Thus, the inventor of the present invention has innovatively recognized a smoking kit that allows the consumer to enjoy a tobacco product that may be optionally configured by the consumer to provide distinct olfacto-gustatory effects or experiences. For example, as stated above, the consumer may choose to smoke the pre-finished product 12 without utilizing a scented wrapper sheet 14. In this case, the consumer will enjoy a fine tobacco product as may be enjoyed in a conventional wrapper.

Alternatively, the consumer may choose to customize the pre-finished product 12 by applying one or more scented wrapper sheets 14 onto the pre-finished product. In one exemplary embodiment, scented wrapper sheet 14 may be made of a homogenized tobacco leaf using tobacco homogenization techniques well understood by those skilled in the art, and would be structurally analogous to sheets used, for example, to make machine-made cigars and cigar wrappings. Alternatively, the scented sheet 14 may be made of a pure tobacco leaf, or may be made of standard wrapping paper as conventionally used for wrapping cigarettes.

Figure 3:
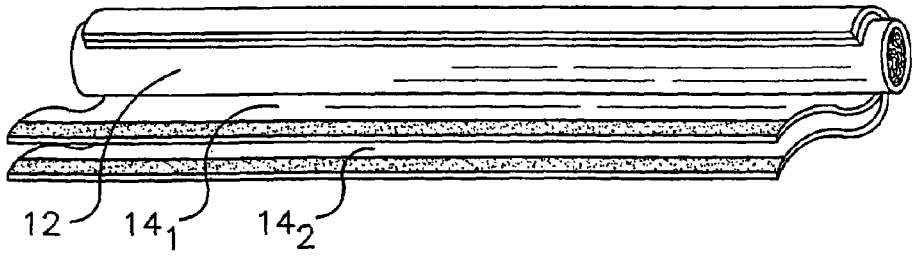
FIG. 3 shows one exemplary embodiment that allows a consumer to wrap multiple scented sheets onto a pre-finished product, and thereby achieves a desired olfacto-gustatory effect.

As set forth below, the olfacto-gustatory experience for the consumer conceptually may be limited just by the imagination and desire of the consumer to experiment with any desired combination of scents and/or flavors. As illustrated in FIG. 3, the consumer has the option of wrapping more than one scented sheet, e.g., scented sheets $\mathbf{14}_1$ and $\mathbf{14}_2$, onto the pre-finished product 12.

Any suitable natural or artificial flavorants and/or scents may be employed to flavor the wrapping sheet 14, such as using aromatizing or flavor/scent-modifying techniques well known in the art. Exemplary types of flavorants and/or scents may comprise spice extracts, flower extracts, and fruit extracts. An exemplary list of exemplary flavorants and/or scents may include the following: acacia, rose, cinnamon, jasmine, apple, martini, banana, berries, blackberry, blueberry, butterscotch, champagne, coffee, chocolate, cognac, cosmopolitan, gin and juice, grape, honey, Jamaica rum, kiwi, strawberry, magic stick, mango, mint, passion fruit, peach, pina colada, raspberry, sour apple, strawberry, strawberry margarita, sweet cherry, vanilla, watermelon.

In one aspect of the present invention, the consumer may optionally strengthen a desired flavor or scent for the finished smoking product by wrapping multiple wrapping sheets comprising the same flavorant or scent. In another aspect of the invention, the consumer may mix and match from wrapping sheets comprising a variety (e.g., a potpourri) of flavorants and/or scents to obtain a desired olfacto-gustatory effect due to the combination of such distinct flavorants and/or scents. For example, the desired effect may be to obtain a resultant scent that the consumer may perceive as distinct but generally pleasant to the senses. Conversely, the desired effect may be to obtain a resultant aroma or scent that the consumer may perceive as shocking. For example, the consumer from time-to-time may desire to reduce his or her smoking rate and accordingly that consumer may experiment and create a resultant combination, e.g., mixing coffee and chocolate scents, that may not be perceived as pleasant to the senses.

Figure 4:
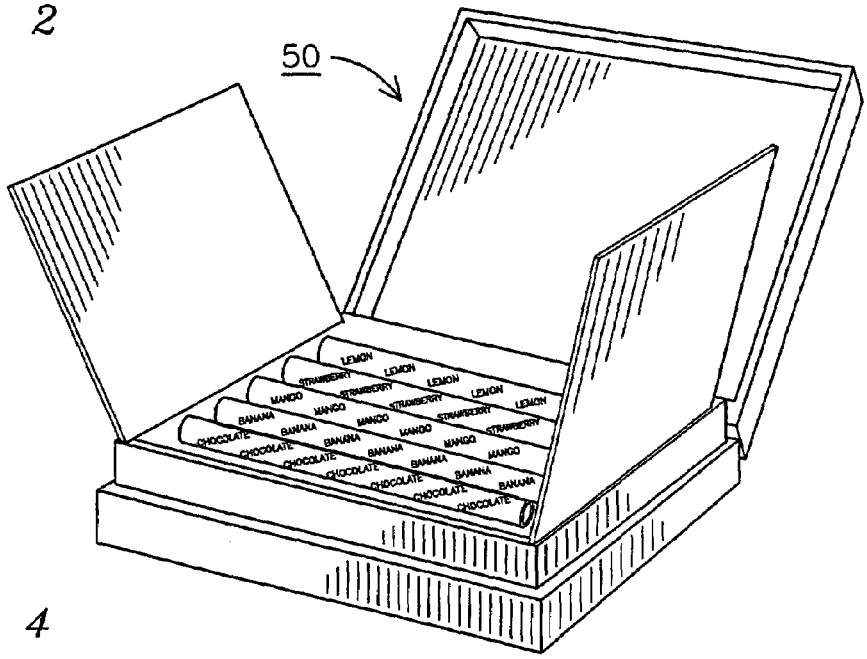
FIG. 4 shows an exemplary packaging that provides a plurality of individually sealed pre-finished smoking products in combination with a plurality of wrapper sheets comprising a variety of scents and/or flavors.

FIG. 4 represents an exemplary packaging that comprises a case 50 including a plurality of pre-finished smoking products in combination with a plurality of wrapper sheets comprising an exemplary variety of scents and/or flavors. The package may comprise individually sealed smoking kits (as described in the context of FIGS. 1 and 2) for conserving the humidity and aroma of the individual tobacco components therein. It will be appreciated that the variety of scents and/or flavors may be personalized to match the desires of a given consumer. Thus, the scents and/or flavors shown in FIG. 4 are just intended to illustrate one example of a possible potpourri of scents and/or flavors. The case may include labeling information (e.g., computer-readable information using a barcode and/or human-readable information such as in the form of a natural language) that may conveniently specify various kit details, such as the flavor of the product, a branding for the kit, the place of production, the production date, and any information intended for the smokers that the applicable laws or regulations of a destination country of the smoking kit may require. Moreover, each individually sealed smoking kit may include suitable indicia (e.g., lettering) of the specific scent so that the consumer can quickly select any desired scent from the potpourri of scents and/or flavors that may be included in the case 50.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A smoking kit comprising:

at least one pre-finished tobacco product, the pre-finished tobacco product being smokable as is; and at least one wrapping sheet loosely wrapped around and supported by said pre-finished tobacco product in a predetermined shape with no adhesive between said at least one wrapping sheet and said pre-finished tobacco product, said wrapping sheet having at least one perceptible olfacto-gustatory characteristic, wherein said wrapping sheet can be unwrapped from said pre-finished tobacco product and can be rolled by a consumer around said pre-finished tobacco product to create a consumer-customized product influenced by the olfacto-gustatory characteristic of the wrapping sheet.

2. The smoking kit of claim 1 further comprising an unwrappable insulator film interposed between said pre-finished tobacco product and said wrapping sheet, the insulator film being intended to prevent flavorants or scents leaching out of said wrapping sheet into said pre-finished tobacco product.

3. The smoking kit of claim 1 of claim wherein said pre-finished tobacco product is selected from the group consisting of a cigar and a cigarette.

4. The smoking kit of claim 1 wherein a consumer-customized smoking product comprises at least two wrapping sheets comprising a same type of olfacto-gustatory characteristics, said at least two wrapping sheets rolled by the consumer around said pre-finished tobacco product to achieve a desired strengthening effect for the at least one perceptible olfacto-gustatory characteristic.

5. The smoking kit of claim 1 wherein a consumer-customized smoking product comprises at least two wrapping sheets having different olfacto-gustatory characteristics, said at least two wrapping sheets rolled by the consumer around said pre-finished tobacco product to achieve a desired combination olfacto-gustatory effect.

6. A smoking product comprising a plurality of individually sealed packages, each package comprising a smoking kit according to claim 1, the smoking product comprising a variety of olfacto-gustatory characteristics.

7. The smoking product of claim 6 wherein each of said individually sealed packages includes indicia indicative of a respective olfacto-gustatory characteristic for a wrapping sheet in said individual package.

8. The smoking kit of claim 1 wherein said pre-determined shape is selected from the group consisting of a cylindrical shape and a conical shape.

9. A method for purveying a tobacco smoking product, said method comprising:

providing a smoking kit, said smoking kit including at least one pre-finished tobacco product, said pre-finished tobacco product being smokable as is; and supporting at least one wrapping sheet loosely wrapped around said pre-finished tobacco product in a predetermined shape with no adhesive between said at least one wrapping sheet and said pre-finished tobacco product, said wrapping sheet having at least one perceptible olfacto-gustatory characteristic, wherein said wrapping sheet can be unwrapped from said pre-finished tobacco product and can be adhesively affixed by a consumer around said finished pre-finished tobacco product to create a consumer-customized smoking product having olfacto-gustatory characteristics influenced by the at least one perceptible olfacto-gustatory characteristic of the wrapping sheet.

10. The method of claim 9 further comprising insulating said wrapping sheet from said pre-finished product prior to use to prevent flavorants or scents leaching out of said wrapping sheet into said pre-finished tobacco product.

11. The method of claim 9 wherein creating a consumer-customized smoking product comprises rolling at least two wrapping sheets comprising similar olfacto-gustatory characteristics around said pre-finished tobacco product to achieve a desired strengthening effect for said olfacto-gustatory characteristics.

12. The method of claim 9 wherein creating a consumer-customized smoking product comprises rolling at least two wrapping sheets having different olfacto-gustatory characteristics around said pre-finished tobacco product to achieve a desired olfacto-gustatory effect.

13. A method of providing a smoking product, the method comprising packing a plurality of individually sealed packages, each package comprising a smoking kit according to claim 1, the smoking product comprising a variety of olfacto-gustatory characteristics.

14. The method of claim 13 further comprising providing for each of said individually sealed packages respective indicia indicative of a respective olfacto-gustatory characteristic for a wrapping sheet in said individual package.

15. The smoking kit of claim 1 comprising a package, the pre-finished tobacco product and the at least one wrapping sheet being packaged in the package.

16. The smoking kit of claim 1 wherein the at least one wrapping sheet is optionally attached to the pro-finished tobacco product without an adhesive.

17. The smoking kit of claim 1 wherein the at least one perceptible olfacto-gustatory characteristic is provided by a material selected from the group consisting of natural and artificial flavorants, natural and artificial scents, spice extracts, flower extracts, fruit extracts, flavorants and scents of acacia, rose, cinnamon, jasmine, apple, martini, banana, berries, blackberry, blueberry, butterscotch, champagne, coffee, chocolate, cognac, cosmopolitan, gin and juice, grape, honey, Jamaica rum, kiwi, strawberry, magic stick, mango, mint, passion fruit, peach, pina colada, raspberry, sour apple, strawberry, strawberry margarita, sweet cherry, vanilla and watermelon, combinations of any two or more of the forgoing flavorants and scents, shocking aromas and scents and a mixture of coffee and chocolate scents.

18. The method of claim 9 comprising employing a package and packaging the pre-finished tobacco product and the at least one wrapping sheet in the package.

19. The method of claim 9 wherein the at least one wrapping sheet is optionally attached to the pre-finished tobacco product without an adhesive.

20. The method of claim 9 wherein the at least one perceptible olfacto-gustatory characteristic is provided by a material selected from the group consisting of natural and artificial flavorants, natural and artificial scents, spice extracts, flower extracts, fruit extracts, flavorants and scents of acacia, rose, cinnamon, jasmine, apple, martini, banana, berries, blackberry, blueberry, butterscotch, champagne, coffee, chocolate, cognac, cosmopolitan, gin and juice, grape, honey, Jamaica rum, kiwi, strawberry, magic stick, mango, mint, passion fruit, peach, pina colada, raspberry, sour apple, strawberry, strawberry margarita, sweet cherry, vanilla and watermelon, combinations of any two or more of the forgoing flavorants and scents, shocking aromas and scents and a mixture of coffee and chocolate scents.

* * * * *